US010801823B2

(12) United States Patent
Nelson et al.

(10) Patent No.: US 10,801,823 B2
(45) Date of Patent: Oct. 13, 2020

(54) INHIBITED EMULSIONS FOR USE IN BLASTING IN REACTIVE GROUND OR UNDER HIGH TEMPERATURE CONDITIONS

(71) Applicant: Dyno Nobel Inc., Salt Lake City, UT (US)

(72) Inventors: Casey L. Nelson, Murray, UT (US); David Lynn Gordon, West Jordan, UT (US); Dave Hunsaker, Syracuse, UT (US); John B. Halander, Salt Lake City, UT (US)

(73) Assignee: Dyno Nobel Inc., Salt Lake City, UT (US)

( * ) Notice: Subject to any disclaimer, the term of this patent is extended or adjusted under 35 U.S.C. 154(b) by 0 days.

(21) Appl. No.: 16/279,532

(22) Filed: Feb. 19, 2019

(65) Prior Publication Data

US 2019/0257632 A1 Aug. 22, 2019

Related U.S. Application Data

(60) Provisional application No. 62/632,818, filed on Feb. 20, 2018, provisional application No. 62/773,766, filed on Nov. 30, 2018.

(51) Int. Cl.

| | |
|---|---|
| ***F42D 1/10*** | (2006.01) |
| ***E21D 9/00*** | (2006.01) |
| ***F42D 5/00*** | (2006.01) |

(52) U.S. Cl.

CPC ..... *F42D 1/10* (2013.01); *E21D 9/006* (2013.01); *F42D 5/00* (2013.01)

(58) Field of Classification Search

CPC ... F42D 1/10; F42D 5/00; E21D 9/006; C06B 23/006; C06B 23/004; C06B 23/02; C06B 47/145

USPC ..... 102/311–313; 86/20.15; 149/46, 109.6, 149/61, 2

See application file for complete search history.

(56) References Cited

U.S. PATENT DOCUMENTS

| | | | |
|---|---|---|---|
| 1,596,622 | A | 8/1926 | Patrick |
| 3,374,128 | A | 3/1968 | Stronza et al. |
| 4,061,511 | A | 12/1977 | Buczuk |
| 4,273,147 | A | 6/1981 | Olney |
| 4,737,207 | A | 4/1988 | Ehrnstrom et al. |

(Continued)

FOREIGN PATENT DOCUMENTS

| | | |
|---|---|---|
| EP | 0460952 | 12/1991 |
| EP | 0895055 | 2/1999 |

(Continued)

OTHER PUBLICATIONS

International Search Report and Written Opinion dated May 28, 2019 for PCT/US2019/018599.

(Continued)

*Primary Examiner* — Michael D David

(74) *Attorney, Agent, or Firm* — Stoel Rives LLP

(57) ABSTRACT

Methods of delivering inhibited emulsions are provided. The methods can include mixing an emulsion with a separate inhibitor solution to form the inhibited emulsion. Inhibitor solutions including water, an inhibitor, and a crystallization point modified are provided. Systems for delivering inhibited emulsions are also provided.

8 Claims, 3 Drawing Sheets

(56) References Cited

U.S. PATENT DOCUMENTS

| | | | | |
|---|---|---|---|---|
| 5,366,571 | A * | 11/1994 | Ruhe | C06B 23/006 149/2 |
| 5,567,911 | A * | 10/1996 | Ekman | C06B 47/145 149/46 |
| 5,907,119 | A * | 5/1999 | Cranney | F42D 5/00 102/289 |
| 6,051,086 | A | 4/2000 | Villamagna et al. | |
| 6,125,761 | A | 10/2000 | Smith, Jr. et al. | |
| 6,165,297 | A * | 12/2000 | Smith | C06B 21/0008 149/109.6 |
| 6,401,588 | B1 | 6/2002 | Atkinson et al. | |
| 10,065,899 | B1 * | 9/2018 | Luna | C06B 43/00 |
| 2004/0055677 | A1 * | 3/2004 | Filippini | B01F 17/005 149/46 |
| 2006/0191614 | A1 | 8/2006 | Wu | |
| 2007/0084532 | A1 | 4/2007 | Burns et al. | |
| 2007/0117710 | A1 | 5/2007 | Lawrence et al. | |
| 2011/0056598 | A1 | 3/2011 | Twomey et al. | |
| 2011/0120603 | A1 | 5/2011 | Cordova et al. | |
| 2014/0230679 | A1 * | 8/2014 | Goodridge | C06B 47/145 102/332 |
| 2014/0311634 | A1 | 10/2014 | McPhail et al. | |
| 2016/0145165 | A1 | 5/2016 | Zank et al. | |
| 2018/0009723 | A1 * | 1/2018 | Paris | C06B 23/001 |
| 2018/0244590 | A1 * | 8/2018 | Beattie | C06B 47/145 |
| 2019/0210939 | A1 * | 7/2019 | Pettersen | C06B 47/145 |

FOREIGN PATENT DOCUMENTS

| | | |
|---|---|---|
| EP | 1458660 | 9/2004 |
| GB | 435588 | 9/1935 |
| RU | 1811520 | 4/1993 |
| RU | 96103417 | 4/1998 |
| RU | 2215983 | 11/2003 |
| RU | 2305674 | 9/2007 |
| WO | 199724298 | 7/1997 |
| WO | 2016065412 | 5/2016 |

OTHER PUBLICATIONS

International Search Report and Written Opinion dated Apr. 9, 2019 for PCT/AU2019/050003.

Office Action dated Jun. 24, 2020 for U.S. Appl. No. 15/756,636.

* cited by examiner

INHIBITED EMULSIONS FOR USE IN BLASTING IN REACTIVE GROUND OR UNDER HIGH TEMPERATURE CONDITIONS

RELATED APPLICATIONS

This application claims the benefit, under 35 U.S.C. § 119(e), of U.S. Provisional Application No. 62/632,818 filed Feb. 20, 2018, and titled "INHIBITED EMULSIONS FOR USE IN BLASTING IN REACTIVE GROUND OR UNDER HIGH TEMPERATURE CONDITIONS," and U.S. Provisional Application No. 62/773,766 filed Nov. 30, 2018, and titled "INHIBITED EMULSIONS FOR USE IN BLASTING IN REACTIVE GROUND OR UNDER HIGH TEMPERATURE CONDITIONS," which are both hereby incorporated by reference in their entireties.

TECHNICAL FIELD

The present disclosure relates generally to explosives. More specifically, the present disclosure relates to methods for delivering inhibited emulsions and systems related thereto. In some embodiments, the methods relate to methods of using an inhibited emulsion to blast in reactive ground and/or under high temperature conditions.

BRIEF DESCRIPTION OF THE DRAWINGS

The embodiments disclosed herein will become more fully apparent from the following description and appended claims, taken in conjunction with the accompanying drawings. The drawings depict primarily generalized embodiments, which embodiments will be described with additional specificity and detail in connection with the drawings in which:

DETAILED DESCRIPTION

Figure 1:
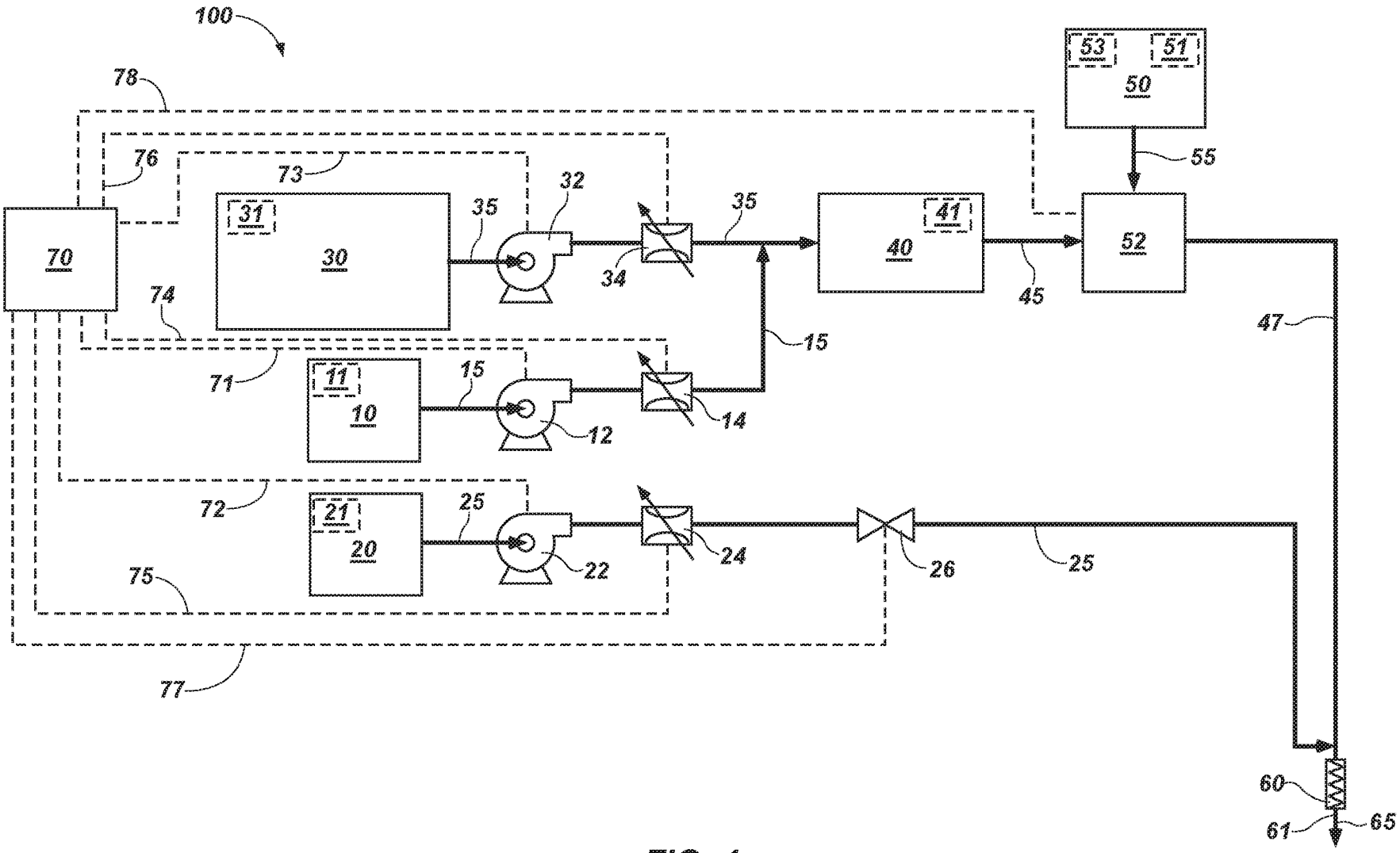
FIG. 1 is a process flow diagram of one embodiment of a system for delivering explosives.

Explosive compositions for use in reactive ground and/or under high temperature conditions are disclosed herein, along with related methods. Explosives are commonly used in the mining, quarrying, and excavation industries for breaking rocks and ore. Generally, a hole, referred to as a "blasthole," is drilled into a surface, such as the ground. An explosive composition may then be placed in the blasthole. Subsequently, the explosive composition may be detonated.

In some embodiments, the explosive composition is an emulsion or blend including the emulsion. In some embodiments, the emulsion includes fuel oil as the continuous phase and an oxidizer as the discontinuous phase. For example, in some embodiments, the emulsion includes droplets of an aqueous oxidizer solution that are dispersed in a continuous phase of fuel oil (i.e., a water-in-oil emulsion).

"Emulsion" as used herein encompasses both unsensitized emulsion matrix and emulsion that has been sensitized into emulsion explosive. For example, the unsensitized emulsion matrix may be transportable as a UN Class 5.1 oxidizer. Emulsion explosives include a sufficient amount of sensitizing agent to render the emulsion detonable with standard detonators. The emulsion may be sensitized at the blast site or even in the blasthole. In some embodiments, the sensitizing agent is a chemical gassing agent. In some embodiments, the sensitizing agent includes hollow microspheres or other solid gas-entraining agents. In some embodiments, the sensitizing agent is gas bubbles that have been mechanically introduced into the emulsion. The introduction of gas bubbles into the emulsion may decrease the density of the emulsion that is delivered to the blasthole.

A potential hazard associated with explosive compositions, such as emulsion explosives, is premature detonation. Generally, explosive material is left in a blasthole for a period of time (i.e., the "sleep time") until it is fired. Stated differently, the sleep time of an explosive material is the time between loading of the material into the blasthole and intentional firing of the explosive material. Premature detonation (i.e., detonation during the intended sleep time) creates significant risks.

One potential cause of premature detonation is placement of the explosive composition in reactive ground. "Reactive ground" is ground that undergoes a spontaneous exothermic reaction when it comes in contact with nitrates, such as ammonium nitrate. Often the reaction involves the chemical oxidation of sulfides (e.g., iron sulfide or copper sulfide) by nitrates and the liberation of heat. In other words, when an explosive composition is placed in reactive ground, the sulfides within the reactive ground may react with nitrates in the explosive composition. The reaction of nitrates with sulfide-containing ground may result in an auto-catalyzed process that can, after some induction time, lead to runaway exothermic decomposition. In some instances, the resulting increase in temperature (i.e., the resulting exotherm) can lead to premature detonation. One example of reactive ground is ground that includes pyrite.

A second potential cause of premature detonation is an elevated ground temperature. An elevated ground temperature may reduce (or supply) the activation energy needed to trigger detonation of an explosive. As used herein the term "high temperature ground" refers to ground at a temperature of 55° C. or higher.

Additionally, ground to be blasted can be both high temperature ground and reactive ground.

Several strategies can be employed to prevent an exotherm and premature detonation. For example, as discussed in further detail below, the explosive composition may include an additive that functions as an inhibitor, such as urea, amines, basic solutions (e.g., aqueous soda ash), sodium nitrate, hydrotalcite, and zinc oxide.

The inhibitor may reduce thermal degradation of the emulsion explosive when the emulsion explosive is in contact with reactive ground and/or ground at an elevated temperature. For example, when the emulsion explosive is in contact with sulfide-containing ground, the inhibitor may reduce the reaction rate between the nitrate salts of the discontinuous oxidizer phase and the sulfides in the reactive ground. It should be understood that the inhibited emulsions disclosed herein may not completely prevent an exotherm and the resulting premature detonation; however, the inhibited emulsions disclosed herein may delay or minimize exotherms and thereby increase the safety of the explosives and increase the safe sleep time for the explosives.

Methods of using the explosive compositions described herein are also disclosed. For example, an emulsion explosive described herein can be used to blast in reactive ground and/or ground at an elevated temperature. For instance, one method of blasting in reactive ground includes the step of placing the emulsion explosive in reactive ground. For instance, the emulsion explosive may be loaded into a blasthole drilled within reactive ground.

The reactive ground may include any minerals that typically react with one or more nitrate salts to produce an exothermic reaction. For instance, in some embodiments, the reactive ground includes one or more sulfides. More particularly, some reactive ground includes an iron sulfide, such as iron pyrite. Ground can be identified as reactive ground by performing the isothermal reactive ground test of the Australian Explosives Industry and Safety Group Inc. (see Australian Explosives Industry and Safety Group Inc., Code of Practice: Elevated Temperature and Reaction Ground, March 2017).

Any methods disclosed herein include one or more steps or actions for performing the described method. The method steps and/or actions may be interchanged with one another. In other words, unless a specific order of steps or actions is required for proper operation of the embodiment, the order and/or use of specific steps and/or actions may be modified. Moreover, sub-routines or only a portion of a method described herein may be a separate method within the scope of this disclosure. Stated otherwise, some methods may include only a portion of the steps described in a more detailed method.

Reference throughout this specification to "an embodiment" or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

The phrases "operably connected to," "connected to," and "coupled to" refer to any form of interaction between two or more entities, including mechanical, electrical, magnetic, electromagnetic, fluid, and thermal interaction. Likewise, "fluidically connected to" refers to any form of fluidic interaction between two or more entities. Two entities may interact with each other even though they are not in direct contact with each other. For example, two entities may interact with each other through an intermediate entity.

The term "proximal" is used herein to refer to "near" or "at" the object disclosed. For example, "proximal the outlet of the delivery conduit" refers to near or at an outlet of the delivery conduit.

As the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

Recitation in the claims of the term "first" with respect to a feature or element does not necessarily imply the existence of a second or additional such feature or element. It will be apparent to those having skill in the art that changes may be made to the details of the above-described embodiments without departing from the underlying principles of the present disclosure.

The methods provided herein may allow or permit an explosives manufacturer to manufacture a single emulsion for use in both reactive ground and non-reactive ground applications. If the emulsion is to be used in a reactive ground application, a user may add an inhibitor solution (i.e., a solution including water, an inhibitor, and a crystallization point modifier) to the emulsion matrix after manufacture of the emulsion matrix. For example, the user may add the inhibitor solution to the emulsion during delivery to the blasthole. Accordingly, the sleep time in reactive ground of an emulsion explosive prepared as disclosed herein may be longer than the sleep time in reactive ground of an emulsion explosive lacking an inhibitor and a crystallization point modifier.

As stated above, the blasthole may be disposed in reactive ground and the emulsion may be an emulsion configured or used for non-reactive ground. A benefit of the methods provided herein may be that the emulsion can be tailored to the level of reactivity of the reactive ground to be blasted, as there generally tends to be a wide variety of reactive ground. For example, the method may include determining ground properties along the length or depth of the blasthole. In some embodiments, detailed information about the blasthole, including a geologic profile, may be determined. In certain embodiments, a geologic profile may be generated based on one or more types of geologic data. Non-limiting examples of geologic data include mineralogy (elemental and/or mineral) and temperature. The geologic data may be determined directly or indirectly from sources such as seismic data (such as received from one or more geophones or other seismic sensors), drilling data, drill cuttings, core samples, sensors (e.g., temperature sensors or chemical sensors coupled to the drill), or combinations thereof. For example, drill cuttings and/or core samples may be analyzed using x-ray or gamma-ray fluorescence, scanning electron microscopy, and other spectroscopy and/or microscopy techniques. The geologic data may include information on an incremental basis, such as on a per foot basis. Knowledge of the geologic profile or the ground properties may be used by one skilled in the art to select an inhibited emulsion tailored to characteristics of the ground containing the blasthole to achieve optimum performance of the explosive.

Systems for delivering explosives and methods related thereto are disclosed herein. It will be readily understood that the components of the embodiments as generally described below and illustrated in the Figures herein could be arranged and designed in a wide variety of different configurations. Thus, the following more detailed description of various embodiments, as described below and represented in the Figures, is not intended to limit the scope of the disclosure, but is merely representative of various embodiments. While the various aspects of the embodiments are presented in drawings, the drawings are not necessarily drawn to scale unless specifically indicated.

FIG. 1 illustrates a process flow diagram of one embodiment of an explosives delivery system 100. The explosives delivery system 100 of FIG. 1 includes various components and materials as further detailed below. Additionally, any combination of the individual components may include an assembly or subassembly for use in connection with an explosives delivery system.

In the embodiments of FIG. 1, the explosives delivery system 100 includes a first reservoir 10 configured to store a first gassing agent 11, a second reservoir 20 configured to store a second gassing agent 21, and a third reservoir 30 configured to store an emulsion matrix 31. The explosives delivery system 100 further includes a homogenizer 40 configured to mix the emulsion matrix 31 and the first gassing agent 11 into a homogenized product 41. In some other embodiments, the explosives delivery system 100 may not include the homogenizer 40. Stated another way, the explosives delivery system 100 may lack a homogenizer.

In some embodiments, the first gassing agent 11 includes a pH control agent. The pH control agent may include an acid. Examples of acids include, but are not limited to, organic acids such as citric acid, acetic acid, and tartaric acid. Any pH control agent known in the art and compatible with the second gassing agent 21 and a gassing accelerator, if present, may be used. The pH control agent may be dissolved in an aqueous solution.

In some embodiments, the first reservoir 10 is further configured to store a gassing accelerator mixed with the first gassing agent 11. The homogenizer 40 may be configured to mix the emulsion matrix 31 and the mixture of the gassing accelerator and the first gassing agent 11 into the homogenized product 41. Examples of gassing accelerators include, but are not limited to, thiourea, urea, thiocyanate, iodide, cyanate, acetate, sulfonic acid and its salts, and combinations thereof. Any gassing accelerator known in the art and compatible with the first gassing agent 11 and the second gassing agent 21 may be used. The pH control agent and the gassing accelerator may be dissolved in an aqueous solution.

In some embodiments, the second gassing agent 21 includes a chemical gassing agent configured to react in the emulsion matrix 31 and with the gassing accelerator, if present. Examples of chemical gassing agents include, but are not limited to, peroxides such as hydrogen peroxide, inorganic nitrite salts such as sodium nitrite, nitrosamines such as N,N'-dinitrosopentamethylenetetramine, alkali metal borohydrides such as sodium borohydride, and bases such as carbonates including sodium carbonate. Any chemical gassing agent known in the art and compatible with the emulsion matrix 31 and the gassing accelerator, if present, may be used. The chemical gassing agent may be dissolved in an aqueous solution.

In some embodiments, the emulsion matrix 31 includes a continuous fuel phase and a discontinuous oxidizer phase. Any emulsion matrix known in the art may be used, such as, by way of non-limiting example, TITAN® 1000 G (DYNO NOBEL®).

Examples of the fuel phase include, but are not limited to, liquid fuels such as fuel oil, diesel oil, distillate, furnace oil, kerosene, gasoline, and naphtha; waxes such as microcrystalline wax, paraffin wax, and slack wax; oils such as paraffin oils, benzene, toluene, and xylene oils, asphaltic materials, polymeric oils such as the low molecular weight polymers of olefins, animal oils, such as fish oils, and other mineral, hydrocarbon or fatty oils; and mixtures thereof. Any fuel phase known in the art and compatible with the oxidizer phase and an emulsifier, if present, may be used.

The emulsion matrix may provide at least about 95%, at least about 96%, or at least about 97% of the oxygen content of the sensitized product.

Examples of the oxidizer phase include, but are not limited to, oxygen-releasing salts. Examples of oxygen-releasing salts include, but are not limited to, alkali and alkaline earth metal nitrates, alkali and alkaline earth metal chlorates, alkali and alkaline earth metal perchlorates, ammonium nitrate, ammonium chlorate, ammonium perchlorate, and mixtures thereof, such as a mixture of ammonium nitrate and sodium or calcium nitrates. Any oxidizer phase known in the art and compatible with the fuel phase and an emulsifier, if present, may be used. The oxidizer phase may be dissolved in an aqueous solution, resulting in an emulsion matrix known in the art as a "water-in-oil" emulsion. The oxidizer phase may not be dissolved in an aqueous solution, resulting in an emulsion matrix known in the art as a "melt-in-oil" emulsion.

In some embodiments, the emulsion matrix 31 further includes an emulsifier. Examples of emulsifiers include, but are not limited to, emulsifiers based on the reaction products of poly[alk(en)yl] succinic anhydrides and alkylamines, including the polyisobutylene succinic anhydride (PiBSA) derivatives of alkanolamines. Additional examples of emulsifiers include, but are not limited to, alcohol alkoxylates, phenol alkoxylates, poly(oxyalkylene)glycols, poly(oxyalkylene) fatty acid esters, amine alkoxylates, fatty acid esters of sorbitol and glycerol, fatty acid salts, sorbitan esters, poly(oxyalkylene) sorbitan esters, fatty amine alkoxylates, poly(oxyalkylene)glycol esters, fatty acid amines, fatty acid amide alkoxylates, fatty amines, quaternary amines, alkyloxazolines, alkenyloxazolines, imidazolines, alkylsulphonates, alkylsulphosuccinates, alkylarylsulphonates, alkylphosphates, alkenylphosphates, phosphate esters, lecithin, copolymers of poly(oxyalkylene)glycol and poly(12-hydroxystearic) acid, 2-alkyl and 2-alkenyl-4,4'-bis(hydroxymethyl)oxazoline, sorbitan mono-oleate, sorbitan sesquioleate, 2-oleyl-4,4'-bis(hydroxymethyl)oxazoline, and mixtures thereof. Any emulsifier known in the art and compatible with the fuel phase and the oxidizer phase may be used.

The explosives delivery system 100 further includes a first pump 12 configured to pump the first gassing agent 11. The inlet of the first pump 12 is fluidically connected to the first reservoir 10. The outlet of the first pump 12 is fluidically connected to the first flowmeter 14 configured to measure a stream 15 of the first gassing agent 11. The first flowmeter 14 is fluidically connected to the homogenizer 40. The stream 15 of the first gassing agent 11 may be introduced into a stream 35 of the emulsion matrix 31 upstream from the homogenizer 40, including before or after, a third pump 32 or, before or after, a third flowmeter 34. The stream 15 may be introduced along the centerline of the stream 35. FIG. 1 illustrates the flow of the stream 15 of the first gassing agent 11 from the first reservoir 10, through the first pump 12 and the first flowmeter 14, and into the homogenizer 40.

The explosives delivery system 100 further includes a second pump 22 configured to pump the second gassing agent 21. The inlet of the second pump 22 is operably connected to the second reservoir 20. The outlet of the second pump 22 is fluidically connected to a second flowmeter 24 configured to measure the flow of a stream 25 of the second gassing agent 21. The second flowmeter 24 is fluidically connected to a valve 26. The valve 26 is configured to control the stream 25 of the second gassing agent 21. The valve 26 is fluidically connected to a delivery conduit (not shown) proximal of the outlet of the delivery conduit and proximal of the inlet of a mixer 60. The valve 26 may include a control valve. Examples of control valves include, but are not limited to, angle seat valves, globe valves, butterfly valves, and diaphragm valves. Any valve known in the art and compatible with controlling the flow of the second gassing agent 21 may be used. FIG. 1 illustrates the flow of the stream 25 of the second gassing agent 21 from the second reservoir 20, through the second pump 22, the second flowmeter 24, and the valve 26, and into stream a 47.

The explosives delivery system 100 further includes the third pump 32 configured to pump the emulsion matrix 31. The inlet of the third pump 32 is fluidically connected to the third reservoir 30. The outlet of the third pump 32 is fluidically connected to the third flowmeter 34 configured to measure the stream 35 of the emulsion matrix 31. The third flowmeter 34 is fluidically connected to the homogenizer 40. FIG. 1 illustrates the flow of the stream 35 of the emulsion matrix 31 from the third reservoir 30, through the third pump 32 and the third flowmeter 34, and into the homogenizer 40.

In some embodiments, the explosives delivery system 100 is configured to convey the second gassing agent 21 at a mass flow rate of less than about 5%, less than about 4%, less than about 2%, or less than about 1% of a mass flow rate of the emulsion matrix 31.

The homogenizer 40 may be configured to homogenize the emulsion matrix 31 when forming the homogenized product 41. As used herein, "homogenize" or "homogenizing" refers to reducing the size of oxidizer phase droplets in the fuel phase of an emulsion matrix, such as the emulsion matrix 31. Homogenizing the emulsion matrix 31 increases the viscosity of the homogenized product 41 as compared to the emulsion matrix 31. The homogenizer 40 may also be configured to mix the stream 35 of the emulsion matrix 31 and the stream 15 of the first gassing agent 11 into the homogenized product 41. The stream 45 of the homogenized product 41 exits the homogenizer 40. Pressure from the stream 35 and the stream 15 may supply the pressure for flowing the stream 45.

The homogenizer 40 may reduce the size of oxidizer phase droplets by introducing a shearing stress on the emulsion matrix 31 and the first gassing agent 11. The homogenizer 40 may include a valve configured to introduce a shearing stress on the emulsion matrix 31 and the first gassing agent 11. The homogenizer 40 may further include mixing elements, such as, by way of non-limiting example, static mixers and/or dynamic mixers, such as augers, for mixing the stream 15 of the first gassing agent 11 with the stream 35 of the emulsion matrix 31.

Homogenizing the emulsion matrix 31 when forming the homogenized product 41 may be beneficial for the sensitized product 61. For example, the reduced oxidizer phase droplet size and increased viscosity of the sensitized product 61, as compared to an unhomogenized sensitized product, may mitigate gas bubble coalescence of the gas bubbles generated by introduction of second gassing agent 21. Likewise, the effects of static head pressure on gas bubble density in a homogenized sensitized product 61 are reduced as compared to an unhomogenized sensitized product. Therefore, gas bubble migration is less in the homogenized sensitized product 61 as compared to an unhomogenized sensitized product. As a result, the as-loaded density of the homogenized sensitized product 61 at a particular depth of a blasthole is closer to the conveyed density of the homogenized sensitized product 61 at that depth than would be the case for the as-loaded density of an unhomogenized sensitized product conveyed instead. The increased viscosity of the homogenized sensitized product 61 also tends to reduce migration of the product into cracks and voids in the surrounding material of a blasthole, as compared to an unhomogenized sensitized product.

In some embodiments, the homogenizer 40 does not substantially homogenize the emulsion matrix 31. In such embodiments, the homogenizer 40 includes elements primarily configured to mix the stream 35 and the stream 15, but does not include elements primarily configured to reduce the size of oxidizer phase droplets in the emulsion matrix 31. In such embodiments, the sensitized product 61 would be an unhomogenized sensitized product. "Primarily configured" as used herein refers to the main function that an element was configured to perform. For example, any mixing element(s) of the homogenizer 40 may have some effect on oxidizer phase droplet size, but the main function of the mixing elements may be to mix the stream 15 and the stream 35.

The explosives delivery system 100 further includes a fourth reservoir 50 configured to store a lubricant 51 and/or an inhibitor solution 53 (discussed in further detail below) and a lubricant injector 52 configured to lubricate conveyance of the homogenized product 41 through the inside of the delivery conduit. The fourth reservoir 50 is fluidically connected to the lubricant injector 52. The lubricant injector 52 may be configured to inject an annulus of the lubricant 51 and/or the inhibitor solution 53 that surrounds the stream 45 of the homogenized product 41 and lubricates flow of the homogenized product 41 inside the delivery conduit. The lubricant 51 may include water. The inhibitor solution 53 may include water, an inhibitor, and a crystallization point modifier. The homogenizer 40 is fluidically connected to the lubricant injector 52. The lubricant injector 52 is operably connected to the delivery conduit. The stream 45 of the homogenized product 41 enters the lubricant injector 52. The stream 55 of the lubricant 51 and/or the inhibitor solution 53 exits the fourth reservoir 50 and is introduced by the lubricant injector 52 to the stream 45. The stream 55 may be injected as an annulus that substantially radially surrounds the stream 45. The stream 47 exits the lubricant injector 52 and includes the stream 45 substantially radially surrounded by the stream 55. The stream 55 of the lubricant 51 and/or the inhibitor solution 53 can lubricate the flow of the stream 45 through the delivery conduit.

In some embodiments, the annulus of the lubricant 51 and/or the inhibitor solution 53 that surrounds the stream 45 of the homogenized product 41 may comprise from about 1 weight percent (wt %) to about 14 wt % of the total product (the lubricant 51 and/or inhibitor solution 53 plus the homogenized product 41 and any sensitizing agent) in the blasthole. In some other embodiments, the annulus of the lubricant 51 and/or the inhibitor solution 53 that surrounds the stream 45 of the homogenized product 41 may comprise from about 2 wt % to about 12 wt %, from about 6 wt % to about 10 wt %, or about 8 wt % of the total product in the blasthole.

The explosives delivery system 100 further includes a delivery conduit. The delivery conduit is operably connected to the lubricant injector. The delivery conduit is configured to convey the stream 47 to the mixer 60. The delivery conduit is configured for insertion into a blasthole.

The explosives delivery system 100 further includes the mixer 60 located proximal the outlet of the delivery conduit. The mixer 60 is configured to mix the homogenized product 41 and the lubricant 51 and/or the inhibitor solution 53 in the stream 47 with the second gassing agent 21 in the stream 25 to form the sensitized product 61 in the stream 65. The mixer may include a static mixer. An example of a static mixer includes, but is not limited to, a helical static mixer. Any static mixer known in the art and compatible with mixing the second gassing agent 21, the homogenized product 41, and the lubricant 51 and/or the inhibitor solution 53 may be used.

In some embodiments, the stream 15 of the first gassing agent 11 is not introduced to the stream 35 upstream from the homogenizer 40. Instead, the stream 15 of the first gassing agent 11 may be introduced to the stream 45 of the homogenized product 41 after the homogenizer 40 or into the stream 47 after the lubricant injector 52. The stream 15 may be injected along the centerline of the stream 45 or the stream 47. In these embodiments, the first gassing agent 11 of the stream 15 may be mixed with the homogenized product 41 and the second gassing agent 25 at the mixer 60.

The explosives delivery system 100 further includes a control system 70 configured to vary the flow rate of the stream 25 relative to the flow rate of the stream 47. The control system 70 may be configured to vary the flow rate of the stream 25 while the sensitized product 61 is continuously formed and conveyed to the blasthole. The control system 70 may be configured to vary the flow rate of the stream 25 while also varying the flow rate of the stream 15, the stream 35, and the stream 55 to change the flow rate of the stream 47.

The control system 70 may be configured to automatically vary the flow rate of the stream 25 as the blasthole is filled with the sensitized product 61, depending upon a desired sensitized product density of the sensitized product 61 at a particular depth of the blasthole. The control system 70 may be configured to determine the desired sensitized product density based upon a desired explosive energy profile within the blasthole. The control system 70 may be configured to adjust the flow rate of the stream 15 of the first gassing agent 11 based on the temperature of the emulsion matrix 31 and the desired reaction rate of the second gassing agent 21 in the homogenized product 41. The temperature of the emulsion matrix 31 may be measured in the third reservoir 30. The control system 70 may be configured to vary the flow rate of the stream 25 to maintain a desired sensitized product density based, at least in part, on variations in the flow rate of the stream 35 to the homogenizer 40.

The control system 70 includes a computer (not shown) including a processor (not shown) operably connected to a memory device (not shown). The memory device stores programming for accomplishing desired functions of the control system 70 and the processor implements the programming. The control system 70 communicates with the first pump 12 via a communication system 71. The control system 70 communicates with the second pump 22 via a communication system 72. The control system 70 communicates with the third pump 32 via a communication system 73. The control system 70 communicates with the first flowmeter 14 via a communication system 74. The control system 70 communicates with the second flowmeter 24 via a communication system 75. The control system 70 communicates with the third flowmeter 34 via a communication system 76. The control system 70 communicates with the valve 26 via a communication system 77. The control system 70 communicates with the lubricant injector 52 via a communication system 78. The communication systems 71, 72, 73, 74, 75, 76, 77, 78 may include one or more wires and/or wireless communication systems.

In some embodiments, the explosives delivery system 100 is configured for delivering a blend of the sensitized product 61 with solid oxidizers and additional liquid fuels. In such embodiments, the delivery conduit may not be inserted into the blasthole, but instead the sensitized product 61 may be blended with solid oxidizer and additional liquid fuel. The resulting blend may be poured into a blasthole, such as from the discharge of an auger chute located over the mouth of a blasthole.

For example, the explosives delivery system 100 may include a fifth reservoir configured to store the solid oxidizer. The explosives delivery system 100 may further include a sixth reservoir configured to store an additional liquid fuel, separate from the liquid fuel that is part of the emulsion matrix 31. A hopper may operably connect the fifth reservoir to a mixing element, such as an auger. The mixing element may be fluidically connected to the sixth reservoir. The mixing element may also be fluidically connected to the outlet of the delivery conduit configured to form the sensitized product 61. The mixing element may be configured to blend the sensitized product 61 with the solid oxidizer of the fifth reservoir and the liquid fuel of the sixth reservoir. A chute may be connected to the discharge of the mixing element and configured to convey blended sensitized product 61 to a blasthole. For example, the sensitized product 61 may be blended in an auger with ammonium nitrate and No. 2 fuel oil to form a "heavy ANFO" blend.

The explosives delivery system 100 may include additional reservoirs for storing solid sensitizers and/or energy increasing agents. These additional components may be mixed with the solid oxidizer of the fifth reservoir or may be mixed directly with the homogenized product 41 or the sensitized product 61. In some embodiments, the solid oxidizer, the solid sensitizer, and/or the energy increasing agent may be blended with the sensitized product 61 without the addition of any liquid fuel from the sixth reservoir.

Examples of solid sensitizers include, but are not limited to, glass or hydrocarbon microballoons, cellulosic bulking agents, expanded mineral bulking agents, and the like. Examples of energy-increasing agents include, but are not limited to, metal powders, such as aluminum powder. Examples of the solid oxidizer include, but are not limited to, oxygen-releasing salts formed into porous spheres, also known in the art as "prills." Examples of oxygen-releasing salts are those disclosed above regarding the oxidizer phase of the emulsion matrix 31. Prills of the oxygen-releasing salts may be used as the solid oxidizer. Any solid oxidizer known in the art and compatible with the liquid fuel may be used. Examples of the liquid fuel are those disclosed above regarding the fuel phase of the emulsion matrix 31. Any liquid fuel known in the art and compatible with the solid oxidizer may be used.

It should be understood that the explosives delivery system 100 may further include additional components compatible with delivering explosives.

It should be understood that the explosives delivery system 100 may be modified to exclude components. For example, the explosives delivery system 100 may exclude the homogenizer 40. For example, the explosives delivery system 100 may be modified to exclude components not necessary for flowing the streams 15, 25, 35. For example, one or more of the first pump 12, the second pump 22, the third pump 32, the first flowmeter 14, the second flowmeter 24, and the third flowmeter 34 may not be present. For example, instead of the first pump 12 being present, the explosives delivery system 100 may rely upon the pressure head in the first reservoir 10 to supply sufficient pressure for flow of the stream 15 of the first gassing agent 11. In another example, the control system 70 may not be present and instead manual controls may be present for controlling the flow of the streams 15, 25, 35, 45.

It should further be understood that FIG. 1 is a process flow diagram and does not dictate physical location of any of the components. For example, the third pump 32 may be located internally within third reservoir 30.

Another aspect of the disclosure is related to methods of delivering an inhibited emulsion to a blasthole. In some embodiments, the method may include supplying an emulsion including a discontinuous oxidizer phase and a continuous fuel phase on a mobile processing unit. The method may include supplying a separate inhibitor solution including water, an inhibitor, and a crystallization point modifier on the mobile processing unit. The method may also include mixing the emulsion with the inhibitor solution on the mobile processing unit to form an inhibited emulsion. Furthermore, the method may include conveying the inhibited emulsion to a blasthole.

In certain embodiments the method may include supplying an emulsion comprising a discontinuous oxidizer phase and a continuous fuel phase and supplying a separate inhibitor solution comprising water, an inhibitor, and a crystallization point modifier. The method may include mixing the emulsion with the inhibitor solution to form an inhibited emulsion and conveying the inhibited emulsion to a blasthole. Furthermore, the method may include determining whether the blasthole is disposed in reactive ground, high temperature ground, or both.

As discussed above, the emulsion and the separate inhibitor solution may be supplied on a mobile processing unit. The emulsion may be mixed with the inhibitor solution on the mobile processing unit to form the inhibited emulsion. Furthermore, the inhibited emulsion may be conveyed to a blasthole from the mobile processing unit. Supplying the separate inhibitor solution may include mixing water, the inhibitor, and the crystallization point modifier on the mobile processing unit. Supplying the separate inhibitor solution may include introducing the inhibitor solution into a reservoir disposed on the mobile processing unit.

In certain embodiments, the emulsion and the separate inhibitor solution may be supplied in a plant or factory. The emulsion may be mixed with the inhibitor solution in the plant to form the inhibited emulsion. The inhibited emulsion may then be supplied on a mobile processing unit. Furthermore, the inhibited emulsion may then be conveyed to a blasthole from the mobile processing unit.

Examples of inhibitors include, but are not limited to, urea, amines, basic solutions (e.g., aqueous soda ash), sodium nitrate, hydrotalcite, and zinc oxide. Any inhibitor known in the art and compatible with the emulsion may be used. In some embodiments, the wt % of the inhibitor in the inhibited emulsion may be about 1 wt % to about 10 wt %, about 1.5 wt % to about 7.5 wt %, about 2 wt % to about 5 wt %, or about 3 wt %.

A "crystallization point modifier" as used herein refers to an agent that, when in a mixture or solution, is configured to reduce the crystallization point of the mixture or the solution. For example, a mixture may have a crystallization point of 18° C., however, when a crystallization point modifier is added to the mixture, the crystallization point of the mixture may decrease to 3° C. In some embodiments, the mixture or solution may include an inhibitor (e.g., urea) and the crystallization point modifier may reduce the crystallization point of the inhibitor in the mixture or solution such that the mixture or solution does not clog or inhibit flow of one or more of the streams (e.g., in a conduit on the mobile processing unit). Examples of crystallization point modifiers include, but are not limited to, calcium nitrate, sodium nitrate, and calcium chloride. Any crystallization point modifier known in the art and compatible with the emulsion may be used. In certain embodiments, the wt % of the crystallization point modifier in the inhibited emulsion may be about 0.1 wt % to about 8 wt %, about 0.5 wt % to about 6 wt %, about 1 wt % to about 5 wt %, or about 2 wt % to about 4 wt %.

The inhibitor solution can also include ethylene glycol. In various embodiments, the wt % of the ethylene glycol in the inhibited emulsion may be about 0.1 wt % to about 1 wt %, about 0.2 wt % to about 0.8 wt %, about 0.3 wt % to about 0.7 wt %, or about 0.4 wt % to about 0.6 wt %. As noted above, the inhibitor solution can also include water. In some embodiments, the wt % of the water in the inhibited emulsion may be about 0.5 wt % to about 10 wt %, about 1 wt % to about 9 wt %, about 2 wt % to about 7 wt %, or about 3 wt % to about 5 wt %. Other suitable weight percentages of the inhibitor, the crystallization point modifier, water, and/or ethylene glycol in the inhibited emulsion may also be within the scope of this disclosure.

In some embodiments, water, the inhibitor, and the crystallization point may be mixed to form the inhibitor solution and then the inhibitor solution may be introduced into a reservoir on the mobile processing unit (e.g., such as the fourth reservoir 50 of FIG. 1). Stated another way, a premixed inhibitor solution may be introduced into a reservoir on the mobile processing unit. In some other embodiments, water, the inhibitor, and the crystallization point may be mixed to form the inhibitor solution within a reservoir disposed on the mobile processing unit.

In certain embodiments, the emulsion can be supplied including an inhibitor (e.g., urea). The method can include mixing the emulsion having the inhibitor with the inhibitor solution such that the concentration of inhibitor in the emulsion is increased. In certain embodiments, supplying the emulsion can include supplying an emulsion matrix. Stated another way, the emulsion may not be sensitized. The method may further include introducing a sensitizing agent (e.g., a chemical gassing agent, hollow microspheres or other solid gas-entraining agents, gas bubbles, etc.) to the emulsion matrix to form an emulsion explosive. The sensitizing agent may be introduced to the emulsion matrix to form the emulsion explosive prior to introduction of the emulsion explosive into a delivery conduit. The mobile processing unit can include the delivery conduit. For example, the delivery conduit may be a component of the mobile processing unit. In other embodiments, the sensitizing agent may be introduced to the emulsion matrix to form the emulsion explosive proximal an outlet of the delivery conduit. For example, the sensitizing agent may be introduced to the emulsion matrix at or adjacent a nozzle coupled to a distal end of the delivery conduit (such as described above the exemplary explosive delivery system 100). In various embodiments, supplying the emulsion may include supplying an emulsion explosive.

In some embodiments, the emulsion (i.e., the emulsion matrix or the emulsion explosive) may be mixed with the inhibitor solution to form the inhibited emulsion prior to introduction of the inhibited emulsion to the delivery conduit. For example, the emulsion and the inhibitor solution can be mixed at a position prior to an inlet of the delivery conduit. In some other embodiments, the emulsion and the inhibitor may be introduced to the delivery conduit and then the emulsion may be mixed with the inhibitor solution to form the inhibited emulsion. The emulsion and the inhibitor may be mixed in the delivery conduit, for example, at a position proximal of an outlet of the delivery conduit.

In certain embodiments, the emulsion may be mixed with the inhibitor solution to form the inhibited emulsion prior to introduction of the inhibited emulsion to the homogenizer. For example, the emulsion and the inhibitor solution can be mixed at a position prior to an inlet of the homogenizer. In certain other embodiments, the emulsion and the inhibitor may be introduced to the homogenizer to form a homogenized product.

The method of delivering the inhibited emulsion to the blasthole may also include determining a concentration, a flowrate, or both of the inhibitor solution to achieve a desired inhibition of reactive ground by the inhibited emulsion. In some embodiments, a first portion of reactive ground may have higher reactivity than a second portion of reactive ground. Accordingly, it may be determined that a higher concentration and/or flowrate of the inhibitor solution should be used for the first portion of reactive ground than for the second portion of reactive ground to inhibit or limit the possibility of premature detonation of the inhibited emulsion in the reactive ground. The method of delivering the inhibited emulsion to the blasthole may also include varying a concentration, a flowrate, or both of the inhibitor solution to achieve a desired inhibition of reactive ground by the inhibited emulsion. For example, where a first portion of reactive ground has a higher reactivity than a second portion of reactive ground, the concentration and/or flowrate of the inhibitor solution may be varied (e.g., increased) for the first portion of reactive ground in comparison to the second portion of reactive ground.

In certain embodiments, an annulus of the inhibitor solution can be injected or introduced into the delivery conduit to lubricate conveyance of the emulsion along at least a portion of the delivery conduit. In various embodiments, the inhibitor solution may be injected or introduced to a centerline of a stream of the emulsion (e.g., within at least a portion of the delivery conduit).

Conveying the inhibited emulsion to the blasthole may include inserting the delivery conduit into the blasthole and/or conveying the inhibited emulsion into the blasthole via the delivery conduit.

Another aspect of the disclosure is related to methods of blasting in reactive ground. In certain embodiments, the method may include supplying an emulsion including a discontinuous oxidizer phase and a continuous fuel phase on a mobile processing unit. The method may include supplying an inhibitor on the mobile processing unit. The method may also include mixing the inhibitor solution at a determined concentration, flowrate, or both with the emulsion on the mobile processing unit to form an inhibited emulsion with sufficient inhibitor to achieve a desired inhibition of particular reactive ground by the inhibited emulsion. Furthermore, the method may include conveying the inhibited emulsion to a blasthole in the particular reactive ground.

In various embodiments, the method of blasting in reactive ground, high temperature ground, or both may include supplying an emulsion comprising a discontinuous oxidizer phase and a continuous fuel phase and supplying an inhibitor. The method may further include mixing the inhibitor at a determined concentration, flowrate, or both with the emulsion to form an inhibited emulsion with sufficient inhibitor to achieve a desired inhibition of particular reactive ground, high temperature ground, or both, by the inhibited emulsion. The method may include conveying the inhibited emulsion to a blasthole in the particular reactive ground, high temperature ground, or both. Furthermore, the method may include determining whether the ground is reactive ground, high temperature ground, or both.

As discussed above, the emulsion and the inhibitor may be supplied on a mobile processing unit. The inhibitor may be mixed with the emulsion on the mobile processing unit to form the inhibited emulsion. Furthermore, the inhibited emulsion may be conveyed to a blasthole from the mobile processing unit.

In some embodiments, the emulsion and the inhibitor may be supplied in a plant. The inhibitor may be mixed with the emulsion in the plant to form the inhibited emulsion. The inhibited emulsion may be supplied on a mobile processing unit. Furthermore, the inhibited emulsion may then be conveyed to a blasthole from the mobile processing unit.

The inhibitor may be a component or ingredient of an inhibitor solution. As discussed above, the inhibitor solution may include water and a crystallization point modifier in addition to the inhibitor. Furthermore, the inhibitor solution may also include ethylene glycol.

In various embodiments, the method of blasting in reactive ground may include determining the concentration, the flowrate, or both of the inhibitor solution to achieve a desired inhibition of particular reactive ground by the inhibited emulsion. The method of blasting in reactive ground may also include varying the concentration, the flowrate, or both of the inhibitor solution to achieve a desired inhibition of particular reactive ground by the inhibited emulsion.

In some embodiments, there may be a plurality of blastholes. Each of the blastholes may have a different level of ground reactivity. In certain embodiments, a first portion of the blastholes (e.g., a first group of one or more blastholes) may have a first level of ground reactivity and a second portion of the blastholes (e.g., a second group of one or more blastholes) may have a second level of ground reactivity. There may also be a third portion, a fourth portion, and so on of the blastholes. Stated another way, the plurality of blastholes may form a pattern wherein each blasthole, or each portion of the blastholes, has a particular or unique level of ground reactivity. The method of blasting in reactive ground may include determining the concentration, the flowrate, or both of the inhibitor solution to achieve a desired inhibition of particular reactive ground by the inhibited emulsion in each of the blastholes or in each of the one or more portions of the blastholes. The method of blasting in reactive ground may also include varying the concentration, the flowrate, or both of the inhibitor solution to achieve a desired inhibition of particular reactive ground by the inhibited emulsion in each of the blastholes or in each of the one or more portions of the blastholes.

Some methods of blasting in reactive ground involve the step of letting the inhibited emulsion sleep for at least one day, at least two days, at least two weeks, at least one month, at least two months, or at least three months. For example, the inhibited emulsion may sleep for some period of time in reactive ground without provoking a runaway exothermic reaction that significantly changes the temperature of the emulsion explosive. The avoidance of such a runaway exothermic reaction may prevent or reduce the risk of premature detonation.

After the inhibited emulsion has been placed in the reactive ground, the inhibited emulsion may be detonated at the desired time. For example, in some embodiments, the inhibited emulsion may be detonated after the inhibited emulsion has been allowed to sleep for a period of greater than three hours, five hours, 12 hours, 24 hours, two days, one week, two weeks, at least one month, at least two months, or at least three months.

Another aspect of the disclosure is related to an inhibitor solution. In some embodiments, the inhibitor solution can include water, an inhibitor, and a crystallization point modifier. The inhibitor solution may also include ethylene glycol.

The wt % of the inhibitor in the inhibitor solution may be about 10 wt % to about 50 wt %, about 20 wt % to about 50 wt %, about 30 wt % to about 50 wt %, or about 40 wt % to about 50 wt %. The wt % of the crystallization point modifier in the inhibitor solution may about 5 wt % to about 35 wt %, about 10 wt % to about 30 wt %, about 12 wt % to about 25 wt %, or about 14 wt % to about 20 wt %. The wt % of the water in the inhibitor solution may be about 15 wt % to about 50 wt %, about 20 wt % to about 45 wt %, about 25 wt % to about 42 wt %, or about 30 wt % to about 40 wt %. The wt % of the ethylene glycol in the inhibitor solution may be about 1 wt % to about 10 wt %, about 2 wt % to about 8 wt %, about 4 wt % to about 6 wt %, or about 5 wt %. Other suitable weight percentages of the inhibitor, the crystallization point modifier, water, and/or ethylene glycol in the inhibitor solution may also be within the scope of this disclosure.

Another aspect of the disclosure is related to an explosives delivery system (analogous to the explosives delivery system 100 of FIG. 1). The explosives delivery system can include an emulsion reservoir (such as the third reservoir 30 of FIG. 1) configured to store an emulsion including a discontinuous oxidizer phase and a continuous fuel phase (such as the emulsion matrix 31 of FIG. 1). The explosives delivery system can also include an inhibitor solution reservoir (such as the fourth reservoir 50 of FIG. 1) configured to store a separate inhibitor solution (such as the inhibitor solution 53 of FIG. 1) including water, an inhibitor, and a crystallization point modifier. A heater may be operably connected to the inhibitor solution reservoir. The heater may be configured to maintain the temperature of the inhibitor solution such that the temperature of the inhibitor solution does not drop below the crystallization point of the inhibitor solution. For example, in cold weather conditions the heater may help maintain the inhibitor solution at a temperature above the crystallization point of the inhibitor solution.

In some embodiments, the explosives delivery system can further include an inhibitor solution injector operably connected to the emulsion reservoir and the inhibitor solution reservoir. The inhibitor solution injector can be configured to introduce the inhibitor solution to the emulsion. Furthermore, a delivery conduit may be operably connected to the inhibitor solution injector. In certain embodiments, the delivery conduit can be configured to convey the emulsion and the inhibitor solution. The delivery conduit may also be configured for insertion into a blasthole.

The explosives delivery system may include a mixer (such as the mixer 60 of FIG. 1) disposed proximal of an outlet of the delivery conduit. In various embodiments, the mixer may be configured to mix the emulsion and the inhibitor solution to form an inhibited emulsion.

The inhibitor solution injector may be a lubricant injector (such as the lubricant injector 52 of FIG. 1) configured to inject an annulus of the inhibitor solution to lubricate conveyance of the emulsion matrix along the delivery conduit. In other embodiments, the inhibitor solution injector may be configured to inject the inhibitor solution to a centerline of a stream of the emulsion matrix within the delivery conduit.

Figure 2:
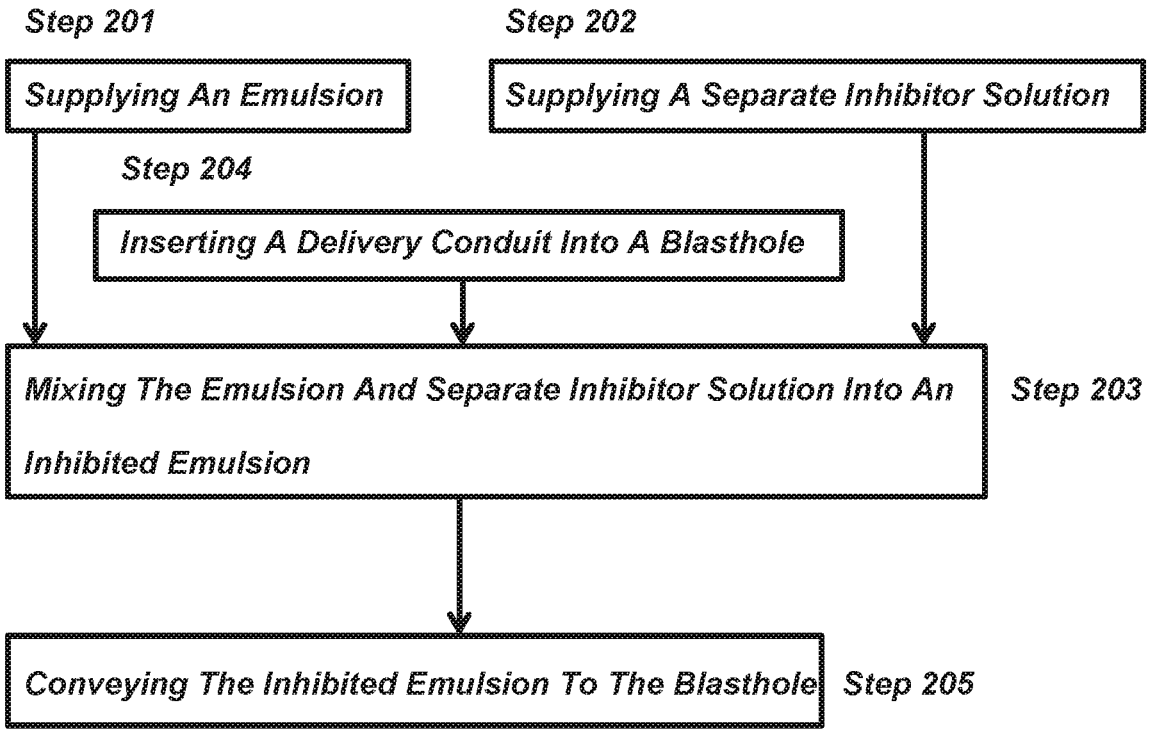
FIG. 2 is a flow chart of one embodiment of a method of delivering an inhibited emulsion to a blasthole.

FIG. 2 is a flow chart of one embodiment of a method of delivering an inhibited emulsion to a blasthole. In this embodiment, the method includes supplying, Step 201, an emulsion; supplying, Step 202, a separate inhibitor solution; and mixing, Step 203, the emulsion and the separate inhibitor solution into an inhibited emulsion. The method further includes inserting, Step 204, a delivery conduit into a blasthole and conveying, Step 205, the inhibited emulsion to the blasthole.

Figure 3:
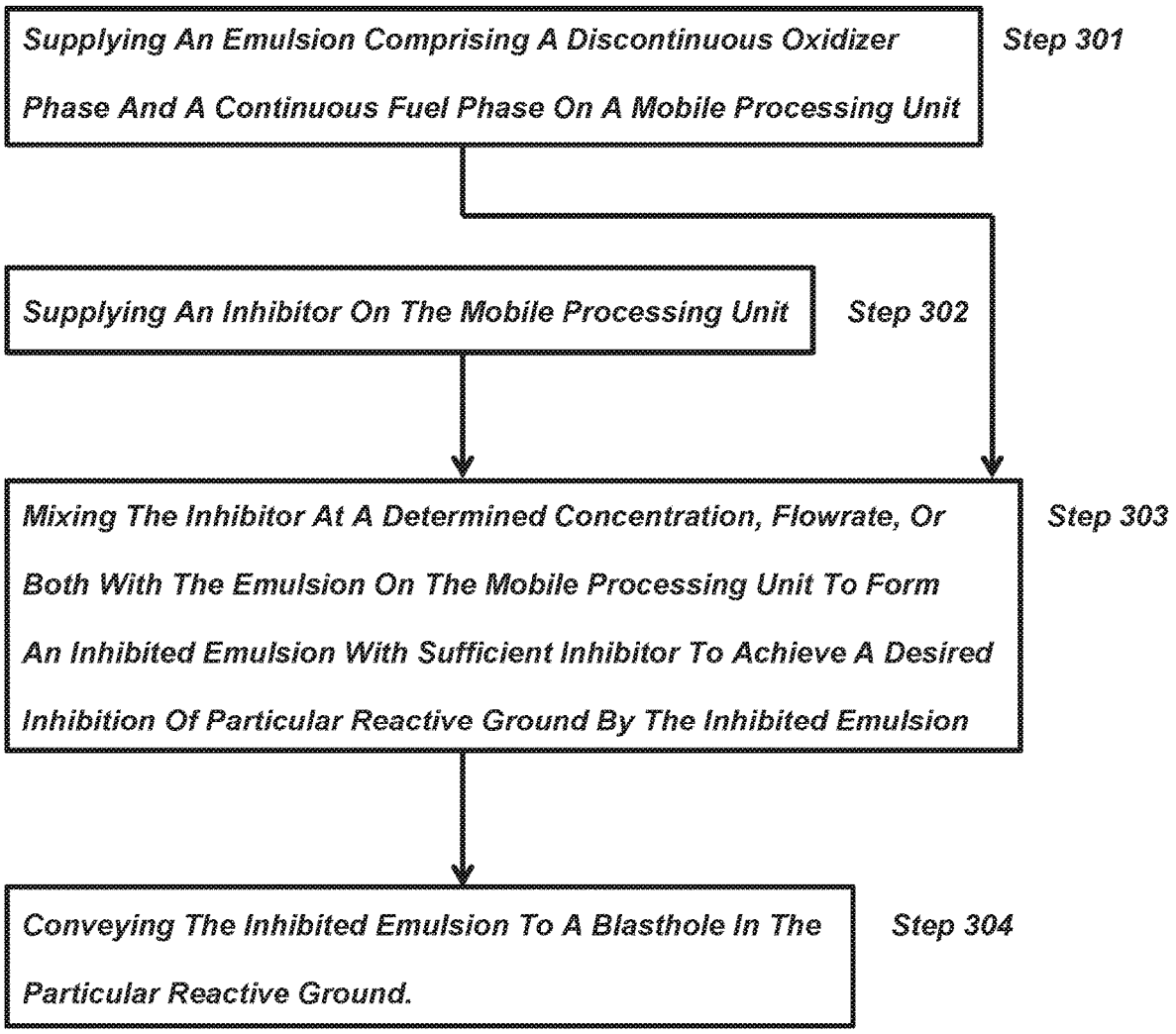
FIG. 3 is a flow chart of one embodiment of blasting in reactive ground.

FIG. 3 is a flow chart of one embodiment of a method of blasting in reactive ground. In this embodiment, the method includes supplying, Step 301, an emulsion comprising a discontinuous oxidizer phase and a continuous fuel phase on a mobile processing unit; supplying, Step 302, an inhibitor on the mobile processing unit; and mixing, Step 303, the inhibitor at a determined concentration, flowrate, or both with the emulsion on the mobile processing unit to form an inhibited emulsion with sufficient inhibitor to achieve a desired inhibition of particular reactive ground by the inhibited emulsion. The method further includes conveying, Step 304, the inhibited emulsion to a blasthole in the particular reactive ground.

EXAMPLE

The following example is illustrative of disclosed methods and compositions. In light of this disclosure, those of skill in the art will recognize that variations of this example and other examples of the disclosed methods and compositions would be possible without undue experimentation.

Example 1

Inhibitor solutions including urea, calcium nitrate, and water were prepared as indicated in Table 1 below. Samples 4 and 5 also included ethylene glycol. The average crystallization point (CP ave.) and the density of each sample was determined.

TABLE 1

| Ingredient | Sample | | | | | | | | |
|---|---|---|---|---|---|---|---|---|---|
| (wt %) | Control | 1 | 2 | 3 | 4 | 5 | 6 | 7 | 8 |
| Urea | 50.0 | 50.0 | 47.5 | 45.0 | 47.5 | 45.0 | 45.0 | 40.0 | 44.0 |
| Calcium nitrate* | — | 15.8 | 15.0 | 14.2 | 15.0 | 14.2 | 17.4 | 19.0 | 17.4 |
| Water | 50.0 | 33.0 | 36.4 | 39.7 | 31.4 | 34.7 | 36.3 | 39.6 | 37.3 |
| Ethylene glycol | — | — | — | — | 5.0 | 5.0 | — | — | — |
| Ammonium nitrate | | 1.2 | 1.1 | 1.1 | 1.1 | 1.1 | 1.3 | 1.4 | 1.3 |
| CP ave. (° C.) | 18 | 3.1 | 2.2 | −8.8 | 2.9 | −2.9 | −7.5 | −16.5 | −9.1 |
| Density (g/mL) | 1.140 | 1.286 | 1.270 | 1.254 | 1.275 | 1.261 | 1.283 | 1.282 | 1.283 |

| Ingredient | Sample | | | | | | | |
|---|---|---|---|---|---|---|---|---|
| (wt %) | 9 | 10 | 11 | 12 | 13 | 14 | 15 | 16 |
| Urea | 46.0 | 42.0 | 44.0 | 45.0 | 46.0 | 44.0 | 45.0 | 42.8 |
| Calcium nitrate* | 18.2 | 16.6 | 16.6 | 19.0 | 18.2 | 18.2 | 19.8 | 16.8 |
| Water | 34.5 | 40.2 | 38.2 | 34.6 | 34.5 | 36.5 | 34.8 | 39.2 |
| Ethylene glycol | — | — | — | — | — | — | — | — |
| Ammonium nitrate | 1.4 | 1.3 | 1.3 | 1.4 | 1.4 | 1.4 | 1.5 | 1.3 |
| CP ave. (° C.) | — | −18.5 | −9.0 | — | — | −6.5 | — | −13.8 |

TABLE 1-continued

| | | | | | | | | |
|---|---|---|---|---|---|---|---|---|
| Density (g/mL) | 1.291 | 1.268 | 1.276 | 1.303 | 1.297 | 1.291 | 1.307 | 1.273 |

*Calcium nitrate was supplied by YARA ™

Without further elaboration, it is believed that one skilled in the art can use the preceding description to utilize the present disclosure to its fullest extent. The examples and embodiments disclosed herein are to be construed as merely illustrative and exemplary and not a limitation of the scope of the present disclosure in any way. It will be apparent to those having skill in the art, and having the benefit of this disclosure, that changes may be made to the details of the above-described embodiments without departing from the underlying principles of the disclosure herein.

The invention claimed is:

1. A method of delivering an inhibited emulsion to a blasthole, the method comprising:

supplying an emulsion comprising a discontinuous oxidizer phase and a continuous fuel phase;

supplying a separate inhibitor solution comprising water, an inhibitor, and a crystallization point modifier;

mixing the emulsion with the inhibitor solution to form an inhibited emulsion; and conveying the inhibited emulsion to a blasthole.

2. The method of claim 1, wherein the emulsion is supplied on a mobile processing unit, wherein the separate inhibitor solution is supplied on the mobile processing unit, wherein the emulsion is mixed with the inhibitor solution on the mobile processing unit to form the inhibited emulsion, and wherein the inhibited emulsion is conveyed to a blasthole from the mobile processing unit.

3. The method of claim 1, wherein supplying the separate inhibitor solution comprises mixing on the mobile processing unit water, the inhibitor, and the crystallization point modifier.

4. The method of claim 1, wherein supplying the emulsion comprises supplying an emulsion matrix.

5. The method of claim 4, further comprising introducing a sensitizing agent to the emulsion matrix to form an emulsion explosive.

6. The method of claim 5, wherein the sensitizing agent is introduced to the emulsion matrix to form the emulsion explosive proximal an outlet of a delivery conduit.

7. The method of claim 1, wherein supplying the emulsion comprises supplying an emulsion explosive.

8. The method of claim 1, further comprising varying a concentration, a flowrate, or both of the inhibitor solution to achieve a desired inhibition of reactive ground by the inhibited emulsion.

* * * * *